US006662779B2

(12) United States Patent
Kotouge

(10) Patent No.: US 6,662,779 B2
(45) Date of Patent: Dec. 16, 2003

(54) SUPPORT STRUCTURE OF VALVE SHAFT FOR BUTTERFLY VALVE

(75) Inventor: Atsurou Kotouge, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/748,128

(22) Filed: Dec. 27, 2000

(65) Prior Publication Data

US 2001/0017124 A1 Aug. 30, 2001

(30) Foreign Application Priority Data

Dec. 28, 1999 (JP) ..... 11-372878

(51) Int. Cl.[7] ..... F02D 1/18

(52) U.S. Cl. ..... 123/336; 123/337; 123/399; 123/361; 73/116

(58) Field of Search ..... 123/336, 337, 123/90.5, 188.14, 399, 361; 73/116

(56) References Cited

U.S. PATENT DOCUMENTS 4,469,016 A * 9/1984 Butler et al. ..... 92/128
4,869,459 A * 9/1989 Bourne ..... 251/58
5,669,347 A * 9/1997 Cullen et al. ..... 123/306
6,116,215 A * 9/2000 Soleanicov et al. ..... 123/399

FOREIGN PATENT DOCUMENTS

JP 6-117260 4/1994
JP 8-200116 8/1996

* cited by examiner

*Primary Examiner*—Hieu T. Vo
*Assistant Examiner*—Johnny H. Hoang
(74) *Attorney, Agent, or Firm*—Foley & Lardner

(57) ABSTRACT

A butterfly valve assembly includes a valve shaft supported by a bearing so as to rotate around its longitudinal axis and having a first end and a second end, an actuator connected to the first end of the valve shaft, and a valve-opening sensor connected to the second end of the valve shaft and having a return spring therein that applies a force to the valve shaft perpendicularly to its longitudinal axis. The return spring disposed in the valve-opening sensor continuously applies its resilient force to both ends of the valve shaft in one direction, so that the valve shaft can be restricted in its free movement within the bearing, therefore the rattling noise, due to the vibration of the valve shaft within the bearing, can be prevented.

12 Claims, 3 Drawing Sheets

SUPPORT STRUCTURE OF VALVE SHAFT FOR BUTTERFLY VALVE

The contents of Japanese Patent Application No. 11-372878, with a filing date of Dec. 28, 1999, in Japan, is incorporated by reference herein, in its entirety.

BACKGROUND OF THE INVENTION

The present invention relates generally to an improvement of a support structure for a valve shaft of a butterfly valve, which is used as, for example, a swirl control valve assembly for a multi-cylinder internal combustion engine.

It is well known that a swirl control valve is disposed on an intake air passage in order to variably control the intensity of swirl gas motion generated in a combustion chamber of an internal combustion engine. The swirl control valve is generally disposed in an intake manifold. The intake manifold rotatably supports a valve shaft of the swirl control valve, and valve bodies, made in a planar shape, are attached to the valve shaft. The swirl control valve opens or closes the intake air passages, each of which is connected to each cylinder of the internal combustion engine, all together by rotating the valve shaft.

Two types of swirl control valve are known; both of them are usually applied to an internal combustion engine that has a pair of intake valves on each cylinder. One type of swirl control valve has valve bodies that are partially cut off in order to make the intake air flow leaned to one side in each intake air passage. Another type has valve bodies that are disposed on the intake air passages each connected to one of the intake valves disposed on each cylinder, and the swirl control valve of this type opens or closes only one of the intake passages connected to each cylinder.

Japanese Provisional Patent (Kokai) Publications Nos. 6-117260 (1994) and 8-200116 (1996) disclose not only the swirl control valves as described above but also actuators to drive valve shafts of the swirl control valves. It is understood that these actuators are generally disposed at the end of the valve shafts.

Japanese Provisional Patent (Kokai) Publication No. 8-200116 (1996) also discloses a valve-opening sensor to detect the opening degree of the valve bodies, which is disposed at the same end of the valve shaft where the rotational actuator is connected so that the valve shaft, the actuator, and the position sensor are arranged in a line.

SUMMARY OF THE INVENTION

In the conventional structures as described above, because the other end of the valve shaft, where the actuator is not connected, is merely supported rotatably to the intake manifold, the intake manifold does not restrict the movement of the valve shaft around and perpendicular to its rotation axis. Therefore, the end of the valve shaft may vibrate within a bearing hole of the intake manifold because of the vibrations of the internal combustion engine itself and/or the change of the intake air pressure, and such vibrations of the valve shaft may cause a rattling noise.

On the other hand, if an actuator that has no return spring to continuously force the valve shaft in one rotational direction is connected to the valve shaft (for example, if an actuator driven by a step motor is connected to the valve shaft), a return spring has to be disposed in addition to the actuator because there is some amount of play at each connection between the actuator and the valve shaft. Such additional return spring may increase the complexity of the structure to some degree.

Therefore, a general object of the invention is to provide an improved support structure of a valve shaft for a butterfly valve that alleviates one or more of the shortcomings discussed earlier herein.

An object of the invention is to provide a support structure of a valve shaft for a butterfly valve that can prevent the rattling noise due to the vibrations of the valve shaft.

Another object of the invention is to provide a simple support structure of a valve shaft even if an actuator has no return spring therein.

The above and other objects of the present invention can be accomplished by a butterfly valve assembly that includes a valve shaft supported by a bearing so as to rotate around its longitudinal axis and having a first end and a second end, an actuator connected to the first end of the valve shaft, and a valve-opening sensor connected to the second end of the valve shaft and having a return spring therein, so that the valve shaft is restricted in its movement within the bearing.

Any type of valve-opening sensors may be employed, such as a sensor having a variable resistor, or a non-contact sensor that has no brush for sliding on the resister. However, regardless of the type, the valve-opening sensor generally has a return spring to prevent movable components therein from moving freely within their play. In the present invention, there is provided the valve-opening sensor having the return spring therein at the second end of the valve shaft opposite to the first end where the actuator is connected, thus the return spring can continuously apply its resilient force to the valve shaft so that the valve shaft is restricted in its movement within the bearing. For example, the resilient force is applied to both ends of the valve shaft in one direction perpendicular to the longitudinal axis of the valve shaft.

The butterfly valve assembly of the present invention may be employed as a swirl control valve that controls intake air flow in intake air passages each of them being connected to each cylinder of a multi-cylinder internal combustion engine. In this case, valve bodies are attached to the valve shaft and each of them is disposed on each intake air passage.

The butterfly valve assembly of the present invention may further include a first linkage device to connect the first end of the valve shaft and the actuator. Each component of the first linkage device can also be restricted in its free movement despite of its play. More specifically, the first linkage device may have a first arm that is fixed to the first end of the valve shaft and rotates together therewith. It has an extended end that extends in the direction perpendicular to the longitudinal axis of the valve shaft, and the actuator is connected thereto. The first arm can not only transmit the rotational force applied to the valve shaft from the return spring to the actuator but also transmit the reaction force applied to the extended end to the first end of the valve shaft as a force perpendicular to the longitudinal axis of the valve shaft, so that the first linkage device can cause firm restriction to the free movement of the valve shaft within the bearing more effectively.

Also at the second end of the valve shaft, a second linkage device can be provided to connect the second end of the valve shaft and the valve-opening sensor. Each component of the second linkage device can also be restricted in its free movement despite of its play. More specifically, the second linkage device may have a second arm that is fixed to the second end of the valve shaft and rotates together therewith. The second arm has an extended end that extends perpendicular to the longitudinal axis of the valve shaft, and the valve-opening sensor is connected thereto. The second arm can transmit the resilient force generated from the return spring to the second end of the valve shaft as a rotational force that is transmitted to the first end of the valve shaft and a force perpendicular to the longitudinal axis of the valve shaft, so that the second linkage device can cause firm restriction to the free movement of the valve shaft within the bearing more effectively.

The valve-opening sensor can be a structure such that it includes a sensor shaft that rotates around its longitudinal axis, and where the return spring applies a resilient force to the sensor shaft in one rotational direction.

Any type of actuator can be employed such as an actuator that is electrically controlled. An example of the electrically controlled actuator of the present invention generates a linear force that is made from a rotational force generated by a step motor disposed within the actuator, so that the actuator has no return spring therein.

According to one aspect of the present invention, the return spring disposed in the valve-opening sensor continuously applies its resilient force to both ends of the valve shaft in one direction, so that the valve shaft can be restricted in its free movement within the bearing, therefore the rattling noise, due to the vibration of the valve shaft within the bearing, can be prevented. Also the whole structure of the butterfly valve assembly can be simplified because the return spring prevents each connection between the valve shaft and the actuator, and between the valve shaft and the valve-opening sensor, from freely moving within its play without using additional return spring.

Also in the case when the first and/or second linkage device being provided, these linkage devices can be prevented from rattling.

Furthermore, even if the actuator has no return spring therein, there is no need to dispose additional return spring other than the one disposed within the valve-opening sensor.

Further objects, features and advantages of the present invention will become apparent from the Detailed Description of Preferred Embodiments which follows when read in light of the accompanying figures and the claims.

DETAILED DESCRIPTION OF THE PREFERRED EMBODIMENTS

Hereinafter, a preferred embodiment of the present invention is described in detail with reference to the attached drawings.

Figure 1:
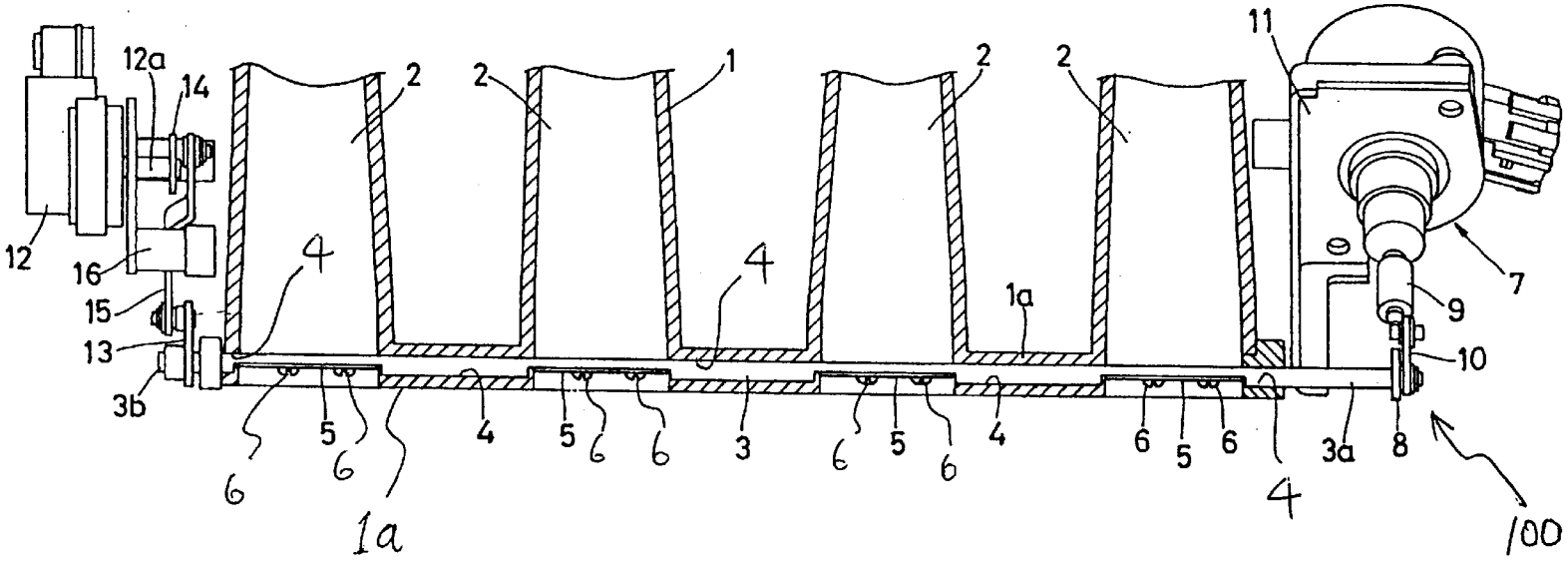
FIG. 1 is a general view of a swirl control valve assembly according to an embodiment of the present invention.

FIG. 1 shows an embodiment of the present invention applied to a swirl control valve assembly of an in-line four-cylinder internal combustion engine. The swirl control valve assembly 100 is disposed at an intake manifold 1 that is attached to a side surface of a cylinder head (not shown). The intake manifold 1 is made of aluminum alloy or other materials by casting, and four intake air passages (2, 2, 2, 2), each of which is connected to an intake port of each cylinder (not shown), are formed therein. A valve shaft 3 is disposed in the intake manifold 1. It is arranged perpendicular to the intake air passages (2, 2, 2, 2), and parallel to the bank of cylinders. The valve shaft 3 is inserted into bearing holes (4, 4 . . . ) that penetrate through a flange portion 1*a* of the intake manifold 1 parallel to the flange surface, so that the intake manifold 1 rotatably supports the valve shaft 3. Valve bodies (5, 5, 5, 5), formed in a planar shape, are secured to the valve shaft 3 by screws (6, 6 . . . ), and each valve body 5 corresponds to each intake air passage 2. Each valve body 5 is partially cut off (or notched) so that the intake air in the intake air passage 2 flows only through the cut-off portion when the valve body 5 closes the intake passage 2.

Figure 3:
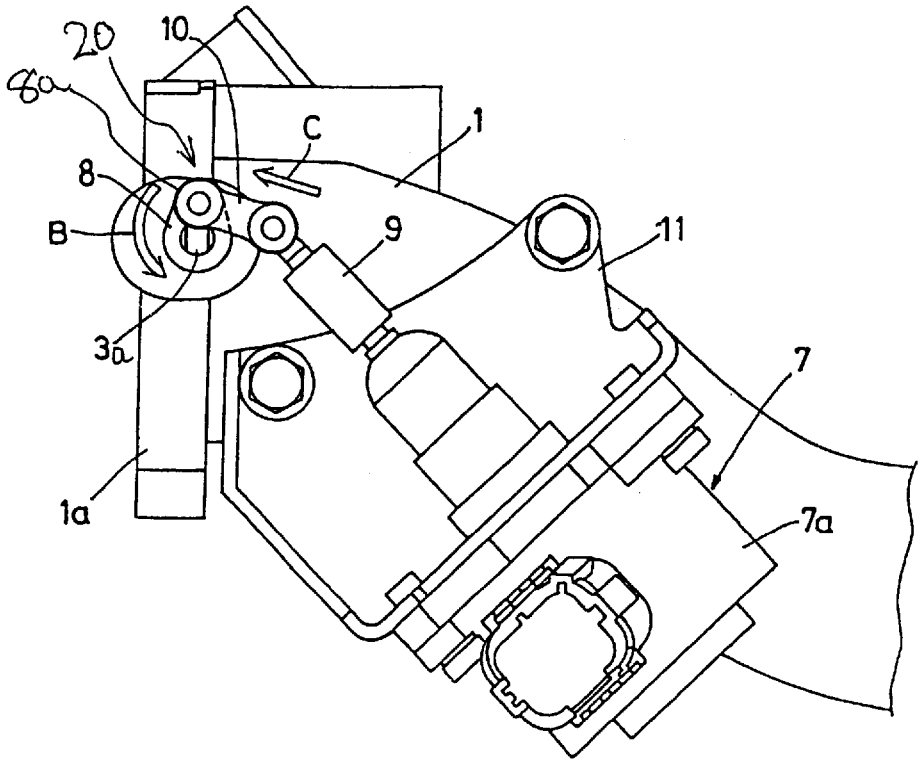
FIG. 3 is a right side view of the swirl control valve assembly shown in FIG. 1 according to an embodiment of the present invention.

The first end 3*a* of the valve shaft 3 (i.e. right end thereof in FIG. 1) comes out from the side surface of the intake manifold 1, and an actuator 7 is connected thereto. As shown in FIG. 3, a first arm plate (or a first arm) 8 is fixed to the first end 3*a*. The first arm plate 8 has an extended end 8*a* that extends perpendicular to the longitudinal axis of the valve shaft 3. There is also provided a first link plate 10, each end of which is connected to the extended end 8*a* and the end of a rod 9 of an actuator 7, respectively, so that the first arm plate 8 and the rod 9 swing around each end of the first link plate 10. The first arm plate 8 and the first link plate 10 make a first linkage device 20 interposed between the valve shaft 3 and the actuator 7, and by means of the first linkage device 20, a linear movement of the rod 9 is transmitted to the valve shaft 3 as a rotational movement.

The actuator 7 has a step motor 7*a* that generates a rotational movement. The number of revolution and the rotational direction of the step motor 7*a* are electrically controlled, and the rotational movement is transmitted to the rod 9 as the linear movement by an internal-screwed gear disposed in the actuator 7 (not shown). The first linkage device 20 and the actuator 7 described above control the valve opening substantially continuously.

The actuator 7 of this embodiments does not have any return spring that forces components for controlling the valve shaft 3 in one direction of their movement. The actuator 7 is attached to the intake manifold 1 by a bracket 11.

Figure 2:
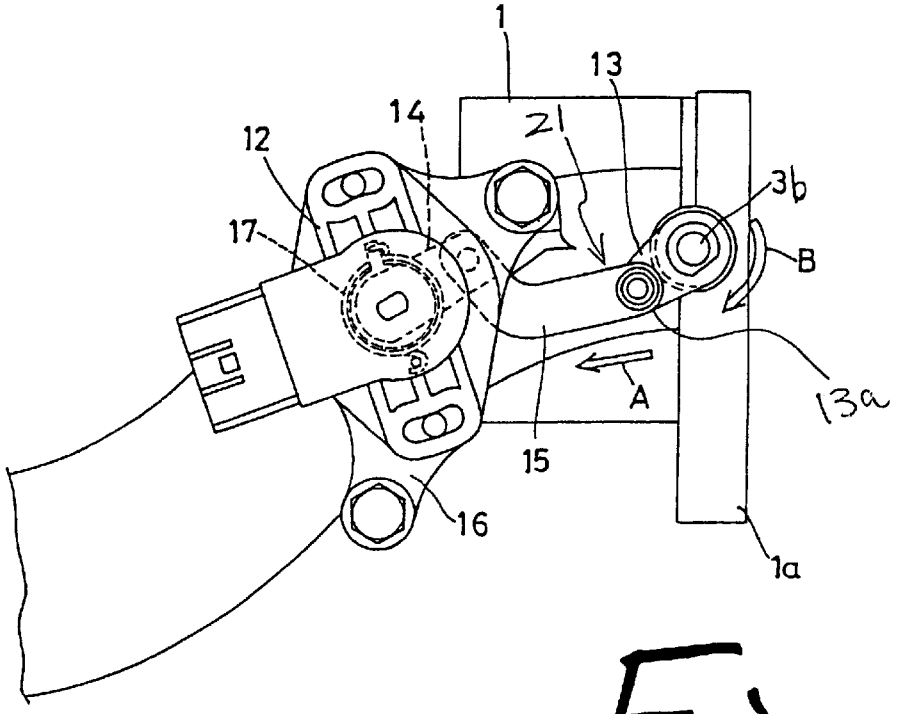
FIG. 2 is a left side view of the swirl control valve assembly shown in FIG. 1 according to an embodiment of the present invention.

Similarly to the first end 3*a*, the second end 3*b* of the valve shaft 3 (i.e. left end thereof in FIG. 1) also comes out from another side surface of the intake manifold 1, and a valve-opening sensor 12 is connected thereto. As shown in FIG. 2, a second arm plate (or a second arm) 13 is fixed to the second end 3*b*. The second arm plate 13 is similar to the first arm plate 8 described above, and it also has an extended end 13*a*. There is provided a second link plate 15, each end of which is connected to the extended end 13*a* and the end of the sensor arm 14 fixed to a rotatable sensor shaft 12*a* of the valve-opening sensor 12, respectively, so that the second arm plate 13 and the sensor arm 14 swing around each end of the second link plate 15. The second arm plate 13 and the second link plate 15 make a second linkage device 21 interposed between the valve shaft 3 and the valve-opening sensor 12, and by means of the second linkage device 21, a rotational movement of the valve shaft 3 is transmitted to the sensor shaft 12*a* of the valve-opening sensor 12.

The valve-opening sensor 12 has, for example, a brush fixed to the sensor shaft 12*a* and a resistor plate, and when the brush swings around the longitudinal axis of the sensor shaft 12*a* because of its rotation, the brush slips on the resistor plate. Because there is some play where the sensor shaft 12*a* is supported, the valve-opening sensor 12 also has a return spring 17 therein in order to force the sensor shaft 12*a* in one rotational direction and thus restricts the free movement of the sensor shaft within its play. Alternatively, the valve-opening sensor 12 may be a non-contact angle sensor that has neither a brush nor a resistor plate. The valve-opening sensor 12 is attached to the intake manifold 1 by a bracket 16.

The return spring 17 continuously applies a counterclockwise rotational force to the sensor shaft 12*a* in FIG. 2. The rotational force pulls the second link plate 15 in the direction shown by the arrow A, and then a clockwise rotational force is continuously applied to the valve shaft 3 as shown by the arrow B. The rotational force applied to the valve shaft in the direction of arrow B is transmitted to the opposite end of the valve shaft 3, where the actuator 7 is disposed (i.e. the first end 3*a* of the valve shaft 3). Therefore, as shown in FIG. 3, the first link plate 10 is pulled in the direction shown by the arrow C. In this embodiment, the force to pull the first link plate 10 is applied to the rod 9 in addition to the driving force of the actuator. However, it does not impair the accuracy to control the valve opening because the force generated by the return spring 17 and applied to the rod 9 is much smaller than the driving force generated by the actuator 7, and because the rod 9 is firmly engaged to an output shaft of the step motor 7*a* by the screwed gear mentioned above.

As described above, by the resilient force generated by the return spring 17, on the side where the valve-opening sensor 12 is disposed, each component of the second linkage device 21 is restricted in its free movement within its play at each connection, and also the second end 3*b* of the valve shaft 3 is firmly restricted in its free movement in the bearing hole 4 because the valve shaft 3 is pulled in one direction perpendicular to the longitudinal axis thereof.

Also on the side of the swirl control valve assembly where the actuator 7 is disposed, each component of the first linkage device 20 is restricted in its free movement within its play at each connection, and the first end 3*a* of the valve shaft 3 is restricted in its free movement in the bearing hole 4 because the reaction force accompanies the force to pull the first link plate 10 and pulls the first end 3*a* of the valve shaft 3 in one direction perpendicular to the longitudinal axis of the valve shaft 3. Therefore, the rattling noise is prevented because both ends (3*a*, 3*b*) of the valve shaft 3 do not vibrate within the bearing hole 4 of the intake manifold 1 despite of the vibrations of the internal combustion engine itself and/or the change of the intake air pressure applied to the valve body 5, and both of the linkage device (20, 21) are also prevented from rattling.

Although the present invention has been described above by reference to certain embodiment of the invention, the invention is not limited to the embodiment described above. Modifications and variations of the embodiment described above will occur to those skilled in the art, in light of the above teachings, and these modifications and embodiments are considered to a part of the present invention.

The scope of the present invention is defined with reference to the following claims.

What is claimed is:

1. A butterfly valve assembly comprising:

a valve shaft supported by a bearing so as to rotate around its longitudinal axis and having a first end and a second end;

an actuator connected to said first end of said valve shaft; and a valve-opening sensor connected to said second end of said valve shaft and having a sensor shaft, which is supported by a support so as to rotate around its longitudinal axis, and a return spring disposed in said valve-opening sensor;

a first free movement of said valve shaft in said bearing into which said first end of said valve shaft is inserted; and a second free movement of said sensor shaft within a play where said sensor shaft is supported by said support, wherein said return spring applies a rotational force to said valve shaft and said sensor shaft to restrict said first free movement at said first end of said valve shaft and said second free movement, respectively.

2. The butterfly valve assembly as claimed in claim 1, wherein said butterfly valve assembly is employed as a swirl control valve that controls intake air flow in intake air passages, and further comprising valve bodies attached to said valve shaft and each of said valve bodies being disposed on each of said intake air passages.

3. The butterfly valve assembly as claimed in claim 1, wherein said actuator is electrically controlled to generate a linear force that is made from a rotational force generated by a step motor disposed in said actuator.

4. A butterfly valve assembly comprising:

a valve shaft rotatable around its longitudinal axis and having a first end and a second end;

an actuator connected to said first end of said valve shaft;

a first linkage device providing a connection between said first end of said valve shaft and said actuator; and a valve-opening sensor connected to said second end of said valve shaft and having a sensor shaft, which is supported by a support so as to rotate around its longitudinal axis, and a return spring disposed in said valve-opening sensor;

a first free movement of said first linkage device within a play at said connection between said first end of said valve shaft and said actuator; and a second free movement of said sensor shaft within a play where said sensor shaft is supported by said support, wherein said return spring applies a rotational force to said valve shaft and said sensor shaft to restrict said first free movement and said second free movement, respectively.

5. The butterfly valve assembly as claimed in claim 4, wherein said first linkage device comprises a first arm that is fixed to said first end of said valve shaft and rotates together therewith, and said first arm has an extended end that extends perpendicular to said longitudinal axis of said valve shaft, and wherein said first linkage device further comprises a first link that is allowed to swing, while said extended end of said first arm and said actuator being correspondingly connected to each end of said first link.

6. The butterfly valve assembly as claimed in claim 5, wherein said butterfly valve assembly is employed as a swirl control valve that controls intake air flow in intake air passages, and further comprising valve bodies attached to said valve shaft and each of said valve bodies being disposed on each of said intake air passages.

7. The butterfly valve assembly as claimed in claim 5, wherein said actuator is provided with a rod, said first link being connected to an end of said rod, said actuator being electrically controlled to generate a linear force that is made from a rotational force generated by a step motor disposed in said actuator, while linearly moving said rod.

8. The butterfly valve assembly as claimed in claim 5, further comprising:

a second linkage device connecting said second end of said valve shaft and said valve-opening sensor, wherein said valve-opening sensor further comprises a sensor arm that is fixed to said sensor shaft and rotates together therewith, said sensor arm having an extended end that extends perpendicular to said longitudinal axis of said sensor shaft, wherein said second linkage device comprises a second arm that is fixed to said second end of said valve shaft and rotates together therewith, and said second arm has an extended end that extends perpendicular to said longitudinal axis of said valve shaft, wherein said second linkage device further comprises a second link that is allowed to swing, while said extended end of said second arm and said sensor shaft being correspondingly connected to each end of said second link, and wherein said return spring applies a force to said second link to be pulled toward said valve-opening sensor to transmit a rotational force to said valve shaft.

9. The butterfly valve assembly as claimed in claim 8, wherein said butterfly valve assembly is employed as a swirl control valve that controls intake air flow in intake air passages, and further comprising valve bodies attached to said valve shaft and each of said valve bodies being disposed on each of said intake air passages.

10. The butterfly valve assembly as claimed in claim 8, wherein said actuator is provided with a rod, said first link being connected to an end of said rod, said actuator being electrically controlled to generate a linear force that is made from a rotational force generated by a step motor disposed in said actuator, while linearly moving said rod.

11. The butterfly valve assembly as claimed in claim 1, wherein said first end of said valve shaft is biased in a direction crossing said longitudinal axis of said valve shaft in relation to said rotational force of said return spring.

12. The butterfly valve assembly as claimed in claim 4, wherein said first end of said valve shaft is biased in a direction crossing said longitudinal axis of said valve shaft in relation to said rotational force of said return spring.

* * * * *